US010480853B2

(12) United States Patent
Lautenschlager et al.

(10) Patent No.: US 10,480,853 B2
(45) Date of Patent: Nov. 19, 2019

(54) METHOD FOR THE CRYOGENIC SEPARATION OF AIR AND AIR SEPARATION PLANT

(71) Applicant: LINDE AKTIENGESELLSCHAFT, Munich (DE)

(72) Inventors: Tobias Lautenschlager, Gröbenzell (DE); Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 369 days.

(21) Appl. No.: 15/328,995

(22) PCT Filed: Jul. 28, 2015

(86) PCT No.: PCT/EP2015/001554
§ 371 (c)(1),
(2) Date: Jan. 25, 2017

(87) PCT Pub. No.: WO2016/015860
PCT Pub. Date: Feb. 4, 2016

(65) Prior Publication Data

US 2017/0234614 A1 Aug. 17, 2017

(30) Foreign Application Priority Data

Jul. 31, 2014 (EP) ..... 14002683

(51) Int. Cl.
*F25J 3/04* (2006.01)

(52) U.S. Cl.
CPC ..... *F25J 3/04412* (2013.01); *F25J 3/042* (2013.01); *F25J 3/0409* (2013.01);
(Continued)

(58) Field of Classification Search
CPC .. F25J 3/04412; F25J 3/04393; F25J 3/04387; F25J 3/04296; F25J 3/0429;
(Continued)

(56) References Cited

U.S. PATENT DOCUMENTS 5,564,290 A * 10/1996 Bonaquist ..... F25J 3/0409 62/646
9,976,803 B2 * 5/2018 Asse ..... F25J 3/04054
(Continued)

FOREIGN PATENT DOCUMENTS

DE 102007014643 A1 9/2007
EP 2 520 886 A1 11/2012

*Primary Examiner* — Kun Kai Ma
(74) *Attorney, Agent, or Firm* — Millen White Zelano & Branigan, PC

(57) ABSTRACT

A method and plant for the cryogenic separation of air, the plant having an air compressor, a heat exchanger and a distillation column system having a low-pressure column at a first pressure and a high-pressure column at a second pressure. Feed air is compressed in the air compressor to a third pressure at least 2 bar above the second pressure A first fraction of compressed feed air is cooled in the heat exchanger and expanded in a first expansion turbine. A second fraction is cooled in the heat exchanger and expanded in a second expansion turbine A third fraction is compressed to a fourth pressure, cooled in the heat exchanger and then expanded. The third fraction is compressed to the fourth pressure in sequence in a recompressor, a hot first turbine booster and a second turbine booster. A dense fluid expander is used to expand the third fraction.

22 Claims, 2 Drawing Sheets

(52) U.S. Cl.
CPC ..... *F25J 3/04018* (2013.01); *F25J 3/04024* (2013.01); *F25J 3/0429* (2013.01); *F25J 3/04054* (2013.01); *F25J 3/04084* (2013.01); *F25J 3/04121* (2013.01); *F25J 3/04145* (2013.01); *F25J 3/04163* (2013.01); *F25J 3/04175* (2013.01); *F25J 3/04296* (2013.01); *F25J 3/04303* (2013.01); *F25J 3/04387* (2013.01); *F25J 3/04393* (2013.01); *F25J 2210/06* (2013.01); *F25J 2215/42* (2013.01); *F25J 2215/50* (2013.01); *F25J 2220/40* (2013.01); *F25J 2240/10* (2013.01); *F25J 2290/12* (2013.01)

(58) Field of Classification Search
CPC ..... F25J 3/042; F25J 3/04145; F25J 3/0409; F25J 3/04084; F25J 3/04054; F25J 3/04018; F25J 2290/12; F25J 2220/40; F25J 2210/06; F25J 2240/10
See application file for complete search history.

(56) References Cited

U.S. PATENT DOCUMENTS

2003/0000248 A1* 1/2003 Brostow ..... F25J 3/0409 62/646
2005/0126221 A1* 6/2005 Ha ..... F25J 3/04024 62/643
2006/0010912 A1* 1/2006 Brugerolle ..... F25J 3/04054 62/643
2007/0209389 A1* 9/2007 Prosser ..... F25J 3/0409 62/643
2008/0011015 A1* 1/2008 Brugerolle ..... C01B 13/0248 62/643
2008/0223075 A1* 9/2008 Tranier ..... F25J 3/04024 62/644
2008/0223077 A1* 9/2008 Prosser ..... F25J 3/0409 62/646
2009/0013869 A1* 1/2009 Rottmann ..... F25J 3/04084 95/42
2009/0064714 A1* 3/2009 Rottmann ..... F25J 3/04054 62/642
2009/0188280 A1* 7/2009 Alekseev ..... F25J 3/0409 62/647
2009/0320520 A1* 12/2009 Parsnick ..... F25J 3/04224 62/648
2010/0037656 A1* 2/2010 Prosser ..... F25J 3/0409 62/643
2010/0313600 A1* 12/2010 Howard ..... F25J 3/0409 62/652
2011/0083470 A1* 4/2011 Rooks ..... F25J 3/0409 62/648
2013/0219959 A1 8/2013 Ha et al.
2013/0255313 A1* 10/2013 Ha ..... F25J 3/04054 62/643
2014/0174123 A1* 6/2014 Rauch ..... F25J 3/04824 62/643
2014/0230486 A1* 8/2014 Lautenschlager .... F25J 3/04084 62/643
2015/0316317 A1* 11/2015 Goloubev ..... F25J 3/0486 62/643
2016/0003531 A1* 1/2016 Goloubev ..... F25J 3/04915 62/650
2016/0025408 A1* 1/2016 Xu ..... F25J 3/04084 62/643
2016/0245585 A1* 8/2016 Howard ..... F25J 3/04412

* cited by examiner

METHOD FOR THE CRYOGENIC SEPARATION OF AIR AND AIR SEPARATION PLANT

The invention relates to a method for the cryogenic separation of air in an air separation plant, and also to a corresponding air separation plant.

PRIOR ART

The production of air products in the liquid or gaseous state by cryogenic separation of air in air separation plants is known and described in the specialist literature, for example in H.-W. Häring (editor), Industrial Gases Processing, Wiley-VCH 2006, in particular section 2.2.5, "Cryogenic Rectification". Air separation plants have distillation column systems that can be designed, for example, as two-column systems, in particular as classical Linde-twin column systems, but also as three- or multicolumn systems. In addition to the distillation columns for producing nitrogen and/or oxygen in the liquid and/or gaseous state (for example liquid oxygen, LOX, gaseous oxygen, GOX, liquid nitrogen, LIN and/or gaseous nitrogen, GAN), that is to say the distillation columns for nitrogen-oxygen separation, distillation columns can be provided for producing further air components, in particular the noble gases krypton, xenon and/or argon.

The distillation column systems are operated at differing operating pressures in the respective distillation columns thereof. Known twin-column systems have, for example, what is termed a high-pressure column (occasionally also merely termed pressure column) and what is termed a low-pressure column. The operating pressure of the high-pressure column is, for example, 4.3 to 6.9 bar, preferably about 5.0 bar. The low-pressure column is operated at an operating pressure of, for example, 1.3 to 1.7 bar, preferably about 1.5 bar. The pressures cited here and hereinafter are absolute pressures.

In the air separation, what are termed high air-pressure methods (HAP methods) can be used. In an HAP method, all of the air which is fed to the air separation plant or all of the air used in a corresponding method (termed feed air) is compressed in a main air compressor to a pressure which is markedly above the highest operating pressure of the distillation column system, typically, therefore, markedly above the operating pressure of the high-pressure column. The pressure difference is at least 2 or 4 bar and preferably between 6 and 16 bar. For example, the pressure is at least twice as high as the operating pressure of the high-pressure column. HAP methods are known, e.g., from EP 2 466 236 A1, EP 2 458 311 A1 and U.S. Pat. No. 5,329,776 A.

In HAP methods, on account of the stronger compression, the vessel and pipeline dimensions required for the air purification can be decreased. In addition, the absolute water content of the compressed air falls. Depending on the boundary conditions present, a refrigeration plant for the air purification can be dispensed with.

In HAP methods, the amount of air compressed in the main air compressor can further be decoupled from the process air amount. In such a case, only a part of the feed air compressed to the stated pressure is used as what is termed process air, that is to say used for the actual rectification and fed into the high-pressure column. A further part is expanded for the production of cold, wherein the amount of cold can be set independently of the process air. Such a decoupling, however, is not provided in all HAP methods.

In addition, methods are known in which the feed air is compressed in the main air compressor only to the highest operating pressure of the distillation column system, typically, therefore, only to the operating pressure of the high-pressure column or slightly above. Some of the feed air can therefore, after cooling, be fed without further expansion into the distillation column system. Only certain fractions which are required, for example, for the additional cold production or else for warming liquid streams (see below), are further compressed in one or more recompressors. Such methods having main compressors and recompressor(s) are also termed main air compressor/booster air compressor methods (MAC/BAC methods). In an MAC/BAC method, therefore, the entire feed air is not compressed, but only a part is compressed to a pressure markedly above the highest operating pressure of the distillation column system.

In the air separation, what is termed internal compression can be used. In internal compression, a liquid stream is taken off from the distillation column system and at least in part brought in the liquid state to pressure. The stream brought in the liquid state to pressure is warmed in a main heat exchanger of the air separation plant against a heat carrier and evaporated or, in the case of the presence of corresponding pressures, transformed from the liquid state to the supercritical state. The liquid stream can be, in particular, liquid oxygen, but can also be nitrogen or argon. Internal compression is therefore used for producing corresponding gaseous pressurized products. The advantage of internal compression methods is, inter alia, that corresponding fluids need not be compressed outside the air separation plant in the gaseous state, which frequently proves to be very complex and/or requires considerable safety measures. Also, internal compression is described in the specialist literature cited at the outset.

Hereinafter, the collective term "deliquefaction" is used for the conversion from the liquid state to the supercritical or gaseous state. The conversion from the supercritical or gaseous state to the liquid state, the product of which is a clearly defined liquid, is termed "liquefaction".

A heat carrier is liquefied against the stream that is to be deliquefied. The heat carrier in this case is customarily formed by some of the air that is fed to the air separation plant. In order to be able to efficiently warm and deliquefy the stream that is brought to pressure in the liquid state, said heat carrier must, on account of thermodynamic circumstances, have a higher pressure than the stream that is brought to pressure in the liquid state. Therefore, a correspondingly highly compressed stream must be provided. Said stream is also termed "throttle stream", because it is conventionally expanded by means of an expansion valve ("throttle"), here at least in part deliquefied and fed into the distillation column system used.

The production of internally compressed gaseous oxygen by means of HAP methods is comparatively inexpensive, in particular owing to the omission of a recompressor for providing a correspondingly highly compressed stream and is achievable in differing embodiments. In certain cases, however, MAC/BAC methods may prove to be energetically more expedient, which is due, in particular, to the use of a turbine (instead of the conventional expansion valve), to which the throttle stream is fed in the liquid state at supercritical pressure and is withdrawn further in the liquid state at subcritical pressure. Such a turbine is termed in the context of this application a dense liquid expander or dense fluid expander (DLE). The energetic advantages of such a dense fluid expander are likewise described in the specialist literature cited at the outset, for example section 2.2.5.6, "Apparatus", pages 48 and 49.

The aim of the present invention is to combine the low capital costs associated with the HAP methods with the efficiency advantages of conventional MAC/BAC methods.

DISCLOSURE OF THE INVENTION

Against this background, the present invention proposes a method for the cryogenic separation of feed air in an air separation plant, and also a corresponding air separation plant having the features described herein.

Before the explanation of the features and advantages of the present invention, the fundamentals thereof and the expressions used will be explained.

An "expansion turbine" or "expansion machine", which can be coupled via a shared shaft to further expansion turbines or energy converters such as oil brakes, generators or compressors, is equipped for expanding a gaseous or at least partially liquid stream. In particular, expansion turbines can be designed for use in the present invention as turbo expanders. If a compressor is driven with one or more expansion turbines, however, but without externally supplied energy, for example by means of an electric motor, the expression "turbine-driven compressor" or alternatively "turbine booster" is used.

A "compressor" is a device which is equipped for compressing at least one gaseous stream from at least one starting pressure at which said stream is fed to the compressor, to at least one final pressure at which said stream is taken off from the compressor. A compressor forms a structural unit which, however, can comprise a plurality of "compressor stages" in the form of piston, screw and/or paddle wheel or turbine arrangements (that is to say axial or radial compressor stages). This also applies, in particular, to the "main (air) compressor" of an air separation plant that is distinguished in that said main (air) compressor compresses all, or the predominant fraction of, the amount of air that is fed into the air separation plant, that is to say the entire feed air stream. A "recompressor", in which in MAC/BAC methods some of the amount of air compressed in the main air compressor is brought to a still higher pressure, is frequently likewise designed to be multistage. In particular, corresponding compressor stages are driven by means of a shared drive, for example via a shared shaft.

Customarily, in MAC/BAC methods, recompressors are used that are driven by means of externally supplied energy, but in HAP methods, such recompressors are not found. Turbine boosters, however, are typically present in both cases, in particular in order to be able to use rationally the shaft output liberated in the expansion for cold production.

A "heat exchanger" serves for the indirect transfer of heat between at least two streams, e.g. conducted in countercurrent to one another, for example a warm compressed air stream and one or more cold streams, or a cryogenic liquid air product and one or more warm streams. A heat exchanger can be formed of a single heat exchanger section or a plurality of heat exchanger sections connected in parallel and/or serially, e.g. of one or more plate heat exchanger blocks. A heat exchanger, for example also the "main heat exchanger" used in the air separation plant which is distinguished in that thereby the main fraction of the streams that are to be cooled, or warmed, respectively, are cooled, or warmed, respectively, has "passages" which are designed as fluid channels that are separate from one another and have heat-exchange surfaces.

To characterize pressures and temperatures, the present application uses the expressions "pressure level" and "temperature level", which is intended to express the fact that corresponding pressures and temperatures in a corresponding plant need not be used in the form of exact pressure or temperature values in order to implement the inventive concept. However, such pressures and temperatures typically vary within certain ranges that are, for example, ±1%, 5%, 10%, 20% or even 50% about a mean value. Corresponding pressure levels and temperature levels can in this case be in disjoint ranges or in ranges that overlap one another. In particular, pressure levels include, for example, unavoidable or expected pressure drops, for example on account of cooling effects, and the same applies correspondingly to temperature levels.

Advantages of the Invention

The method according to the invention uses an air separation plant having a main air compressor, a main heat exchanger and a distillation column system having a low-pressure column operated at a first pressure level and a high-pressure column operated at a second pressure level. The said pressure levels and further pressure levels used are specified in detail hereinafter.

In the method according to the invention, a feed air stream which comprises all of the feed air fed to the air separation plant is compressed in the main air compressor to a third pressure level which is at least 2 bar, in particular at least 4 bar, above the second pressure level. The third pressure level can, for example, also be twice that of the second pressure level. Therefore, an HAP method is carried out.

Of the compressed feed air stream, a first fraction is cooled at least once in the main heat exchanger and is expanded starting from the third pressure level in a first expansion turbine. "Cooled at least once" here and hereinafter is taken to mean that a corresponding stream before and/or after the expansion is conducted at least once at least through one section of the main heat exchanger.

A second fraction is similarly treated, that is to say is likewise cooled at least once in the main heat exchanger and, in a second expansion turbine, is expanded starting from the third pressure level. The second fraction is what is termed the turbine stream, the expansion of which proceeds in order to provide additional cold in a corresponding plant and to be able to control this.

A third fraction is further compressed to a fourth pressure level and then likewise cooled at least once in the main heat exchanger and expanded starting from the fourth pressure level. The third fraction is what is termed the throttle stream which, as explained hereinbefore, in particular permits the internal compression.

Air of the first fraction and/or of the second fraction and/or of the third fraction is then fed into the distillation column system at the first and/or at the second pressure level. Typically, in this case, all of the air in the first fraction is fed into the high-pressure column at the second pressure level. All of the air or part of the air of the second fraction can be fed at the first pressure level into the low-pressure column and/or at the second pressure level into the high-pressure column. The same applies correspondingly to the third fraction.

The present invention is based on the perception that a combination of an HAP method associated with the energetic efficiency of an MAC/BAC method is particularly advantageous not only with respect to the construction costs but also with respect to the operating costs of an air separation plant. As explained, in particular the use of a dense fluid expander is particularly expedient from the energetic viewpoint (that is to say with respect to the operating cost), whereas the use of an HAP method permits low construction costs. The use of a dense fluid expander, however, is not advantageous in conventional HAP methods because the energy savings achievable by a dense fluid expander are coupled to the pressure difference occurring at the dense fluid expander. At relatively low entry pressures and therefore relatively low pressure differences, the use is overall less profitable. Also, the Q, T-profiles that are improved by the increased pressures of an MAC/BAC method cannot be achieved conventionally by means of an HAP method.

In HAP methods, the final pressure of the main air compressor (here, therefore, the "third pressure level") is dependent not only on the internal compression pressures, that is to say the pressures of the gaseous air products that are to be provided by means of internal compression, but also on the amount of the liquid air products that are to be obtained. The former dependence results from the vaporization capacity of a corresponding stream substantially set by the pressure, the latter from the amount of cold "taken off" by the withdrawal of the liquid air products, which must be compensated for by expansion of a further stream.

Since the amount of air of the feed air stream, that is to say the amount of air of all of the feed air compressed by the main air compressor is fixed by the amount of the air products generated, more or less energy can only be fed to the plant via a variation of the final pressure of the main air compressor. On account of technical and economic limits (pipe classes used), this is typically limited to approximately 23 bar.

Under these boundary conditions, in conventional HAP methods, a satisfactory pressure cannot be provided that permits the use of a liquid turbine to appear advantageous. As mentioned, the use of a liquid turbine is only technically advantageous if, hereby, a sufficient pressure difference can be achieved.

The present invention therefore proposes that the third fraction is further compressed to the fourth pressure level successively in a recompressor, a first turbine booster and a second turbine booster. Therefore, instead of the usual maximum of two compression steps which are typically implemented by two turbine boosters, at least three compression steps are used, of which two are implemented by a turbine booster each and one by a recompressor. Hereby, a markedly higher fourth pressure level can be achieved. In this case, at least the first turbine booster is operated in the warm, that is to say not as a cold compressor. This permits a particularly energetically expedient operation of the process. The recompressor is, in the invention, designed as a single-stage, two-stage or multistage compressor.

As explained, although conventionally recompressors are used in MAC/BAC methods, which recompressors are driven by means of externally supplied energy, but are not used in HAP methods, the present invention proposes precisely this. The recompressor used in the context of the present invention is a compressor driven with external energy, which is therefore not driven, or at least not driven solely, by expansion of a fluid previously compressed in the air separation plant itself. With regard to the differing possibilities of driving a recompressor with external energy provided according to the invention, reference may be made to the explanations hereinafter.

The invention, via said compression, permits a provision of the third fraction (throttle stream) at a markedly higher fourth pressure level that makes the use of a dense fluid expander energetically meaningful. Therefore, it is provided according to the invention, to use, for the expansion of the third fraction, a corresponding dense fluid expander, to which the third fraction is fed in the liquid state and at the fourth (supercritical) pressure level.

The third fraction (throttle stream) can be fed to the second turbine booster, in particular according to the amount of the liquid air product or liquid air products that are to be obtained in a corresponding air separation plant and are to be withdrawn therefrom, at differing temperature levels.

To provide relatively large amounts of one or more liquid air products, it has proved to be particularly advantageous to feed the third fraction to the first turbine booster at a temperature level of 0 to 50° C., and to the second turbine booster at a temperature level of −40 to 50° C. Also, the second turbine booster is therefore not a typical cold compressor, that is to say not a "cold" turbine booster. Although the third fraction (throttle stream) is fed thereto, optionally markedly below the ambient temperature, downstream of the second turbine booster its temperature is however above the ambient temperature.

If relatively large amounts of air products are to be withdrawn in the liquid state from a corresponding air separation plant, "cold" turbine boosters are less advantageous, as the total available cold output for providing said liquid air products is used. A cold turbine booster, however, unavoidably contributes heat into the system, since the heat of compression from the compressed stream typically cannot be removed in an aftercooler, but only in the main heat exchanger, associated with a corresponding heat input. A turbine booster operated at relatively high entry temperatures, at which the compressed stream has markedly higher temperatures than, for example, existing cooling water, permits an effective removal of heat in a conventional aftercooler. By removing the heat of compression downstream of the second turbine booster, the compression therein is substantially thermally neutral, since the work of compression here is compensated for by the aftercooler.

Overall, the use of the second turbine booster operated at the stated higher entry temperatures therefore permits the withdrawal of a comparatively large amount of 3 to 10 mol % of the feed air stream in the form of liquid air products, for example liquid oxygen (LOX), liquid nitrogen (LIN) and/or liquid argon (LAR).

For an air separation plant which in contrast is intended to provide predominantly or exclusively gaseous air products (but which, however, also can be obtained for example from liquid intermediate products by means of internal compression methods), it is, in contrast, advantageous to feed the third fraction to the first turbine booster at a temperature level of 0 to 50° C. and to the second turbine booster at a temperature level of −140 to −20° C. The second turbine booster in this case is a typical cold compressor, that is to say a "cold" turbine booster. Thereto is fed the third fraction (throttle stream) beneath the ambient temperature, downstream of the second turbine booster the temperature thereof is in addition (markedly) below the ambient temperature. The temperature of the third fraction that is compressed in the second turbine booster can be, for example, −90 to 20° C. directly downstream of the second turbine booster.

A cold turbine booster introduces heat into the system, since the heat of compression is typically not removed from the compressed stream in an aftercooler which is operated by cooling water, but only in the main heat exchanger itself, associated with a corresponding heat input. A cold turbine booster permits, via said heat input that is intended in the present case, a particularly good warming and deliquefaction of internal compression products and is suitable for air separation plants for generating large amounts of corresponding gaseous pressurized products and comparatively small amounts of liquid air products.

Overall, the use of a second turbine booster operated at the mentioned low entry temperatures, therefore permits a withdrawal of a comparatively small amount of up to 3 mol % of the feed air stream in the form of liquid air products, for example liquid oxygen (LOX), liquid nitrogen (UN) and/or liquid argon (LAR).

The invention advantageously envisages driving said turbine boosters in each case by one of the expansion turbines, for example the first turbine booster by the second expansion turbine and the second turbine booster by the first expansion turbine.

The recompressor that is additionally used for compressing the third fraction (throttle stream), in contrast, is driven using external energy, that is to say not via assigned expansion turbines that each expand air fractions of the feed air stream. It can be advantageous, for example, to drive the recompressor with high-pressure fluid and/or electrically and/or together with a compressor stage of the main air compressor. In the latter case, at least one compressor stage of the main air compressor and at least one compressor stage of the recompressor, are assigned, for example, to a shared shaft. Also, a use of a plurality of corresponding measures can proceed simultaneously.

It is particularly advantageous to cool the third fraction in the main heat exchanger before and after the further compression in the second turbine booster. The third fraction is withdrawn from or fed to the main heat exchanger in this case at suitable temperature levels. As explained, in addition in cases in which the second turbine booster is operated at the higher temperatures mentioned, an additional aftercooling can be provided downstream of the second turbine booster and upstream of a renewed feed into the main heat exchanger. If, in contrast, the second turbine booster is operated at the lower temperatures mentioned, this is, as explained, not the case.

The cooling in the main heat exchanger takes place, in this case, after the recompression in the second turbine booster from a temperature level that depends on the entry and exit temperature of the second turbine booster and possible aftercooling, that is to say, for example from 10 to 50° C. or −90 to 20° C. to a temperature level of −140 to −180° C.

It can also be advantageous if the first fraction, before the expansion in the first expansion turbine, is cooled in the main heat exchanger to a temperature level of 0 to −150° C. Advantageously, the first fraction, after the expansion in the first expansion turbine, is cooled in the main heat exchanger to a temperature level of −130 to −180° C. In other words, the first fraction, after the expansion in the first expansion turbine, is therefore again conducted through the main heat exchanger.

The second fraction is advantageous, before the expansion in the second expansion turbine, cooled in the main heat exchanger to a temperature level of −50 to −150° C.

In the context of the present invention, advantageously, the first pressure level is 1 to 2 bar and/or the second pressure level is 5 to 6 bar and/or the third pressure level is 8 to 23 bar and/or the fourth pressure level is 50 to 70 bar absolute pressure, when the second turbine booster is operated at the higher temperatures mentioned. If the second turbine booster is operated at the lower temperatures mentioned, advantageously, the first pressure level is 1 to 2 bar and/or the second pressure level is 5 to 6 bar and/or the third pressure level is 8 to 23 bar and/or the fourth pressure level is 50 to 70 bar absolute pressure. The third pressure level can in this case still be achieved each time using conventional HAP main air compressors, the fourth pressure level, in particular achieved using said recompressor, permits the use of a dense fluid expander. The fourth pressure level in this case is at supercritical pressure.

The method according to the invention permits, in particular, at least one liquid air product to be withdrawn from the distillation column system, to pressurize it in the liquid state, to vaporize it in the main heat exchanger or to convert it to the supercritical state ("deliquefy") and to remove it as at least one internal compression product from the air separation plant, that is to say as mentioned repeatedly, for use with an internal compression method.

The at least one internal compression product can be removed from the air separation plant at a pressure of 6 bar to 100 bar. The method according to the invention is suitable, owing to the additional above explained heat input, in particular for providing internal compression products at comparatively high pressure, that is to say at at least 30 bar, when the second turbine booster is operated at the lower temperatures mentioned.

The invention also relates to an air separation plant having all the means that enable it to carry out a method explained above. Therefore reference is explicitly made to the features and advantages that have been explained above.

The invention will be explained in more detail hereinafter with reference to the accompanying drawing, which indicates preferred embodiments of the invention.

DETAILED DESCRIPTION OF THE DRAWING

Figure 1:
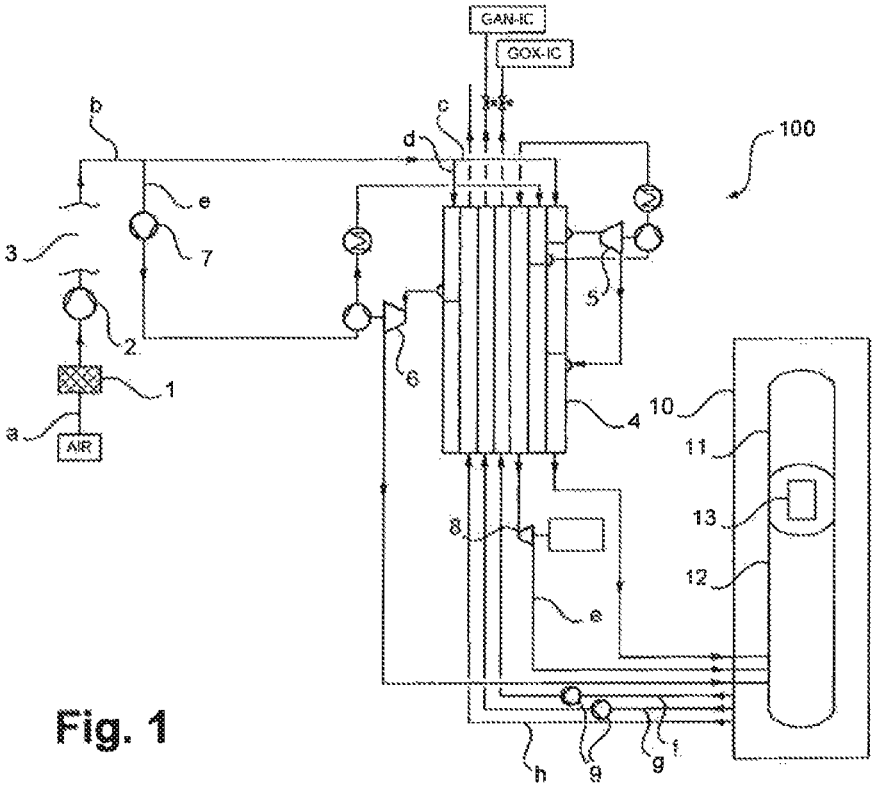
FIG. 1 shows an air separation plant according to an embodiment of the invention in the form of a schematic plant diagram.

In FIG. 1, an air separation plant according to a particularly preferred embodiment of the invention is shown schematically and denoted overall with 100. Feed air (AIR) in the form of a feed air stream a is fed to the air separation plant 100, prepurified by a filter 1 and then fed to a main air compressor 2. The main air compressor 2 is illustrated in highly schematic form. The main air compressor 2 typically has a plurality of compressor stages that can be driven by one or more electric motors via a shared shaft.

Downstream of the main air compressor 2, the feed air stream a that is compressed therein, which in this case is all of the feed air treated in the air separation plant 100, is fed to a purification appliance 3 that is not shown and there freed, for example, from residual moisture and carbon dioxide. A compressed (and purified) feed air stream b is present downstream of the purification appliance 3 at a pressure level of, for example, 15 to 23 bar, in the context of this application denoted third pressure level. The third pressure level in the example shown is markedly above the operating pressure of a typical high-pressure column of an air separation plant as explained at the outset. It is therefore an HAP method.

The feed air stream b is successively divided into streams c, d and e. The stream c in the context of this application is designated as first fraction, stream d as second fraction and stream e as third fraction of the feed air stream b.

Streams c and d are fed to the air separation plant 100 separately from one another on the warm side of a main heat exchanger 4 and removed from said main heat exchanger again at differing intermediate temperature levels. The stream c, after the withdrawal from the main heat exchanger 4, is expanded in an expansion turbine 5, that in the context of this application is designated first expansion turbine, to a pressure level of, for example, 5 to 6 bar, that in the context of this application is designated as second pressure level, and once more conducted through a section of the main heat exchanger 4. The stream d, after the withdrawal from the main heat exchanger 4, is expanded in an expansion turbine 6, that in the context of this application is designated as second expansion turbine, likewise to the second pressure level.

The stream e is what is termed the throttle stream which, in particular, permits the internal compression. The stream e for this purpose is first recompressed in a recompressor 7 and then in two turbine boosters, each of which is driven by the first expansion turbine 5 and the second expansion turbine 6 (not shown separately). The turbine booster that is driven by the second expansion turbine 6 is here designated as first turbine booster, and the turbine booster driven by the first expansion turbine 5, in contrast, is designated as second turbine booster. In principle, the assignment of the turbine boosters to the expansion turbines 5, 6 can also be in reverse. The recompression proceeds to a pressure level of, for example, 50 to 70 bar, that in the context of this application is designated as fourth pressure level. Downstream of the recompressor 7 and upstream of the turbine booster, the stream e is at a pressure level of, for example, 26 to 36 bar. The recompressor 7 is driven by external energy, that is to say not by an expansion of compressed air fractions of the feed air stream b.

After the recompression steps in the two turbine boosters, the stream e is cooled back down, in each case in aftercoolers of the turbine boosters that are not shown separately to a temperature that corresponds to about the cooling water temperature. A further cooling proceeds as shown by means of the main heat exchanger 4, depending on requirement. At the fourth pressure level, the stream e is therefore conducted once more through an aftercooler and thereafter through the main heat exchanger 4 and subsequently expanded in a dense fluid expander 8. The fourth pressure level is markedly above the critical pressure of nitrogen and above the critical pressure of oxygen.

After the cooling in the main heat exchanger 4 and upstream of the dense fluid expander 8, the stream e is in the liquid state at supercritical pressure. The dense fluid expander 8 is coupled, for example, to a generator or an oil brake (without designation). After the expansion, the stream e is here present at the second pressure level. It is in addition liquid, but is at a subcritical pressure.

The distillation column system 10 is shown in highly simplified form. It comprises at least one low-pressure column 11 that is operated at a pressure level of 1 to 2 bar (here designated as first pressure level) and a high-pressure column 12 that is operated at the second pressure level of a twin-column system in which the low-pressure column 11 and the high-pressure column 12 are in heat-exchanging connection via a main condenser 13. For the sake of clarity, there is no specific depiction of the pipelines, valves, pumps, further heat exchangers and the like that feed the low-pressure column 11 and the high-pressure column 12 and these and that connect the main condenser 13.

The streams c, d and c are fed into the high-pressure column 12 in the example shown. However, it can also be proposed to feed, for example, the stream d and/or the stream e, after appropriate expansion, into the low-pressure column 11 and/or not to feed fractions into the distillation column system.

In the example shown, the streams f, g and h can be withdrawn from the distillation column system 10. The air separation plant 100 is equipped to carry out an internal compression method, as explained repeatedly. In the example shown, the streams f and g, which can be a liquid, oxygen-rich stream f and a liquid, nitrogen-rich stream g, are therefore pressurized by means of pumps 9 in the liquid state and vaporized in the main heat exchanger 4, or, depending on pressure, converted from the liquid state to the supercritical state. Fluid of the streams f and g can be withdrawn from the air separation plant 100 as internally-compressed oxygen (GOX-IC) or internally compressed nitrogen (GAN-1C). The stream h illustrates streams withdrawn from one or more of the distillation column system 10 in the gaseous state at the first pressure level.

Figure 2:
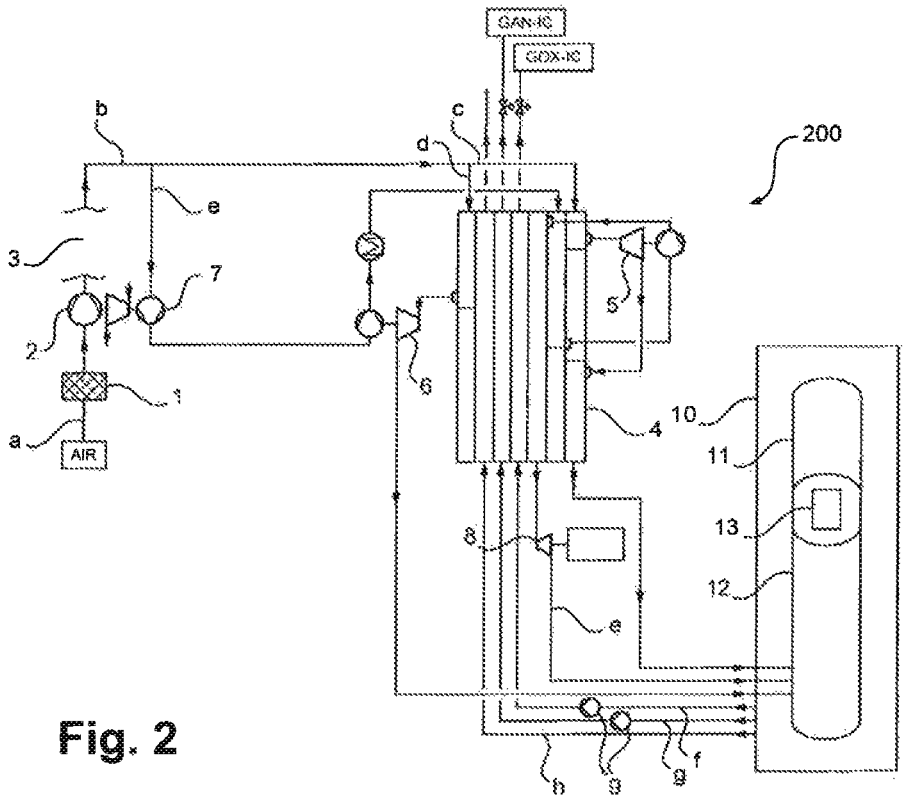
FIG. 2 shows an air separation plant according to an embodiment of the invention in the form of a schematic plant diagram.

In FIG. 2, an air separation plant according to a typically preferred embodiment of the invention is shown schematically and designated overall with 200. The same or comparable plant components and streams as in the air separation plant 100 shown in FIG. 1 are given identical reference signs and the explanation is not repeated.

The feed air stream b is also here downstream of the purification appliance 3 at a third pressure level, that, however, here is, for example, 9 to 17 bar. The fourth pressure level to which the stream e (throttle stream) is compressed, is here, for example, 30 to 80 bar. Whereas the stream e, even here after the recompression step in the first turbine booster is cooled back down, in an aftercooler that is not shown separately to a temperature that corresponds about to the cooling water temperature, performs a cooling downstream of the second turbine booster only by means of the main heat exchanger 4, but not by means of an aftercooler as in the air separation plant 100 in accordance with FIG. 1. Since the second turbine booster is operated as a "cold" turbine booster, the stream e downstream of said second turbine booster is at a correspondingly low temperature level markedly below the ambient temperature.

In the example of the air separation plant 100 shown, the recompressor 7 is driven together with one or more compressor stages of the main air compressor 2 and, using a pressure fluid, e.g. pressurized steam that is expanded in an expansion turbine (designated separately). As mentioned, an air separation plant 100 according to FIG. 1, in which the second turbine booster is operated as a "warm" turbine booster, in particular for the provision of relatively large amounts of liquid air products (which are not shown), or an air separation plant 200 according to FIG. 2, in contrast, in which the second turbine booster is operated as a "cold" turbine booster, in particular for the provision of gaseous internal compression products at a high pressure, are suitable.

The invention claimed is:

1. A method for cryogenic separation of air in an air separation plant having a main air compressor, a main heat exchanger, and a distillation column system, said distillation column having a low-pressure column and a high-pressure column, said method comprising:

operating said low-pressure column at a first pressure level and operating said high-pressure column at a second pressure level, compressing a feed air stream, which comprises all of the feed air that is to be fed to the air separation plant, in the main air compressor to a third pressure level which is at least 2 bar above the second pressure level, to form a compressed feed air stream, cooling a first fraction of the compressed feed air stream at least once in the main heat exchanger and expanding the first fraction from the third pressure level in a first expansion turbine, cooling a second fraction of the compressed feed air stream at least once in the main heat exchanger and expanding the second fraction from the third pressure level in a second expansion turbine, and further compressing a third fraction of the compressed feed air stream to a fourth pressure level, and then cooling the third fraction at least once in the main heat exchanger and expanding the third fraction starting from the fourth pressure level, and feeding at least part of the first fraction and/or of the second fraction and/or of the third fraction, at the first and/or at the second pressure level, into the distillation column system, wherein the further compressing of the third fraction to the fourth pressure level is performed by successive compression in a second compressor, a first turbine booster, and a second turbine booster, and the expanding of the third fraction is performed in a dense fluid expander wherein the third fraction is fed into the dense fluid expander in the liquid state and at the fourth pressure level, and the third fraction is fed to the first turbine booster at a temperature level of 0 to 50° C.

2. The method as claimed in claim 1, wherein the third fraction is fed to the second turbine booster at a temperature level of −40 to 50° C.

3. The method as claimed in claim 2, wherein at least one liquid air product is withdrawn from the air separation plant in a fraction of 3 to 10 mol % of the feed air stream.

4. The method as claimed in claim 2, wherein the third fraction, after compression in the second turbine booster is cooled in an aftercooler starting from a temperature level above ambient temperature and thereafter further cooled in the main heat exchanger from a temperature level of 10 to 50° C. to a temperature level of −140 to −180° C.

5. The method as claimed in claim 1, wherein the first pressure level is 1 to 2 bar, the second pressure level is 5 to 6 bar, the third pressure level is 8 to 23 bar and/or the fourth pressure level is 50 to 70 bar absolute pressure.

6. The method as claimed in claim 1, wherein the third fraction is fed to the second turbine booster at a temperature level of −140 to −20° C.

7. The method as claimed in claim 6, wherein at least one liquid air product is withdrawn from the air separation plant in a fraction of up to 3 mol % of the feed air stream.

8. The method as claimed in claim 6, wherein the third fraction, after compression in the second turbine booster, is cooled in the main heat exchanger from a temperature level of −90 to 20° C. to a temperature level of −140 to −180° C.

9. The method as claimed in claim 6, wherein the first pressure level is 1 to 2 bar, the second pressure level is 5 to 6 bar, the third pressure level is 9 to 17 bar and/or the fourth pressure level is 30 to 80 bar absolute pressure.

10. The method as claimed in claim 1, wherein the first turbine booster and the second turbine booster are each driven by one of the first and second expansion turbines.

11. The method as claimed in claim 1, wherein the further compressor is driven by high-pressure fluid and/or electrically and/or together with a compressor stage of the main air compressor.

12. The method as claimed in claim 1, wherein, before the expansion of the first fraction, the first fraction is cooled in the main heat exchanger to a temperature level of 0 to −150° C.

13. The method as claimed in claim 1, wherein, after the expansion of the first fraction, the first fraction is cooled in the main heat exchanger to a temperature level of −150 to −180° C.

14. The method as claimed in claim 1, wherein, before the expansion of the second fraction, the second fraction is cooled in the main heat exchanger to a temperature level of −100 to −160° C.

15. An air separation plant for cryogenic separation of air comprising:

a main air compressor, a main heat exchanger and a distillation column system having a low-pressure column operated at a first pressure level and a high-pressure column operated at a second pressure level, wherein said main air compressor provides for compressing a feed air stream to a third pressure level that is at least 2 bar above the second pressure level a line for introducing a first fraction of the compressed feed air stream into the main heat exchanger wherein the first fraction is cooled, and a first expansion turbine for expanding the cooled first fraction from the third pressure level, a line for introducing a second fraction of the compressed feed air stream into the main heat exchanger wherein the second fraction is cooled and a second expansion turbine for expanding the cooled second fraction from the third pressure level, compressor means for further compressing a third fraction of the compressed feed air stream to a fourth pressure level, a line for introducing the further compressed third fraction into the main heat exchanger wherein the third fraction is cooled, and an expansion means for expanding the third fraction from the fourth pressure level, and one or more lines for feeding at least a part of the first fraction and/or of the second fraction and/or of the third fraction at the first and/or at the second pressure level into the distillation column system, wherein said compressor means for further compressing the third fraction to the fourth pressure level the comprises in succession a second compressor, a first turbine booster, and a second turbine booster, and said expansion means for expanding the third fraction at the fourth pressure level comprises a dense fluid expander which expands the third fraction in the liquid state.

16. The method as claimed in claim 1, wherein, after the expansion of the first fraction, the first fraction is cooled in the main heat exchanger to a temperature level of −130 to −180° C.

17. The method as claimed in claim 1, wherein, before the expansion of the second fraction, the second fraction is cooled in the main heat exchanger to a temperature level of −50 to −150° C.

18. A method for cryogenic separation of air in an air separation plant having a main air compressor, a main heat exchanger, and a distillation column system, said distillation column having a low-pressure column and a high-pressure column, said method comprising:

operating said low-pressure column at a first pressure level and operating said high-pressure column at a second pressure level, compressing a feed air stream, which comprises all of the feed air that is to be fed to the air separation plant, in the main air compressor to a third pressure level which is at least 2 bar above the second pressure level, to form a compressed feed air stream, cooling a first fraction of the compressed feed air stream in the main heat exchanger, expanding the cooled first fraction from the third pressure level in a first expansion turbine, and cooling the expanded first fraction in the main heat exchanger before introducing at least in part the first fraction into the distillation column system, cooling a second fraction of the compressed feed air stream in the main heat exchanger, expanding the second fraction from the third pressure level in a second expansion turbine, and introducing at least in part the expanded second fraction into the distillation column system, further compressing a third fraction of the compressed feed air stream to a fourth pressure level, cooling the further compressed third fraction in the main heat exchanger, expanding the cooled third fraction from the fourth pressure level, and introducing at least in part expanded third fraction into the distillation column system, wherein the further compressing of the third fraction to the fourth pressure level is performed by successive compression in a further compressor, a first turbine booster, and a second turbine booster, and the expanding of the third fraction is performed in a dense fluid expander wherein the third fraction is fed into the dense fluid expander in the liquid state and at the fourth pressure level, and the third fraction is fed to the first turbine booster at a temperature level of 0 to 50° C.

19. The method as claimed in claim 18, wherein the cooled first fraction is expanded in the first expansion turbine from the third pressure level to the second pressure level.

20. The method as claimed in claim 18, wherein the second fraction is expanded in the second expansion turbine from the third pressure level to the second pressure level.

21. The method as claimed in claim 18, wherein the cooled third fraction is expanded in the dense fluid expander from the fourth pressure level to the second pressure level.

22. The method as claimed in claim 18, wherein, after compression in the first turbine booster, the third fraction is cooled in the main heat exchanger before being compressed to the fourth pressure level in the second turbine booster.

* * * * *